US006653914B2

(12) United States Patent
Gapski et al.

(10) Patent No.: US 6,653,914 B2
(45) Date of Patent: Nov. 25, 2003

(54) RF STRIP LINE RESONATOR WITH A CURVATURE DIMENSIONED TO INDUCTIVELY CANCEL CAPACITIVELY CAUSED DISPLACEMENTS IN RESONANT FREQUENCY

(75) Inventors: Dietmar Gapski, Duisburg (DE); Volker Detering, Emmerich (DE); Jurgen Lepping, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 97 days.

(21) Appl. No.: 09/816,568

(22) Filed: Mar. 23, 2001

(65) Prior Publication Data

US 2001/0050602 A1 Dec. 13, 2001

Related U.S. Application Data

(63) Continuation-in-part of application No. 09/197,047, filed on Feb. 22, 1999, now abandoned, which is a continuation-in-part of application No. 08/793,665, filed on Feb. 28, 1997, now abandoned.

(51) Int. Cl.[7] ..... H01P 7/08; H01P 1/203
(52) U.S. Cl. ..... 333/219; 333/204
(58) Field of Search ..... 333/204, 205, 333/219, 235

(56) References Cited

U.S. PATENT DOCUMENTS 3,967,223 A * 6/1976 McAvoy ..... 333/219
4,129,842 A * 12/1978 Torii et al. ..... 333/219 X
4,625,185 A * 11/1986 Burzi et al. ..... 333/204
4,749,963 A * 6/1988 Makimoto et al. ..... 331/99
5,055,809 A * 10/1991 Sagawa et al. ..... 333/219
5,369,383 A * 11/1994 Takahashi et al. ..... 333/204
5,406,238 A * 4/1995 Suzuki ..... 333/219

FOREIGN PATENT DOCUMENTS

JP 58-223902 * 12/1983 ..... 333/219
JP 2-246601 * 10/1990 ..... 333/219
JP 5-110316 * 4/1993 ..... 333/129
JP 5-110317 * 4/1993 ..... 333/219

* cited by examiner

*Primary Examiner*—Barbara Summons
(74) *Attorney, Agent, or Firm*—Bell Boyd & Lloyd LLC

(57) ABSTRACT

In order to compensate changes in the resonant frequency of the resonator occurring owing to fluctuations in the distance between the reference distance ($d_s$) and an actual distance ($d_s \pm \Delta d_s$) in an RF strip line resonator with a strip line (10) which is arranged at a desired distance ($d_s$) from a metallic conductor (11), the strip line (10) is curved. This curvature induces eddy currents in the conductor (11). The eddy currents bring about a reduction in the inductance of the RF strip line resonator. The smaller/larger the distance between the strip line and the metallic conductor becomes, the smaller/larger this inductance becomes. Since shortening/lengthening the distance between the two conductors is however also accompanied by an increase/reduction in the capacitance of the RF strip line resonator, with the correct dimensioning of the curved strip line the two aforesaid effects cancel one another out and the frequency of the RF strip line resonator is approximately stable with respect to the given fluctuations in distance.

8 Claims, 7 Drawing Sheets

PSB1

PSB2

PSB3

PSB4

RF STRIP LINE RESONATOR WITH A CURVATURE DIMENSIONED TO INDUCTIVELY CANCEL CAPACITIVELY CAUSED DISPLACEMENTS IN RESONANT FREQUENCY

CROSS-REFERENCE TO RELATED APPLICATIONS

This is a Continuation-in-part application Ser. No. 09/197,047, filed Feb. 22, 1999, now abandoned, which is a Continuation-in-part application Ser. No. 08/793,665, filed Feb. 28, 1997, now abandoned.

BACKGROUND OF THE INVENTION

1. Field of the Invention

The present invention relates to an RF strip line resonator.

2. Description of the Related Art

RF strip line resonators are required in oscillatory circuits which are constructed using strip line technology and are required for specific applications. A significant field of application is, for example, radio-telecommunications technology in which radio-telecommunications are transmitted in the radio wave range. The subdivisions of radio-telecommunications technology which cover the radio wave range are, for example, radio technology, television technology, mobile radio technology and satellite technology.

In mobile radio technology, which is to be considered primarily below, there are a number of mobile radio systems for transmitting telecommunications, which systems differ in terms of (a) the field of application (public mobile radio or non-public mobile radio)

(b) the transmission method (FDMA=Frequency Division Multiple Access; TDMA=Time Division Multiple Access; CDMA=Code Division Multiple Access;), (c) the transmission range (from a few meters up to several kilometers), (d) the frequency range used for the transmission, (800–900 MHz; 1800–1900 MHz).

Examples of this are the public GSM mobile radio system with a transmission range of several kilometers and a frequency range for telecommunications transmission between 800 and 900 MHz (Group Spéciale Mobile or Global Systems for Mobile Communications; cf. the publication entitled Informatik Spektrum [computing publication], Springer Verlag Berlin, Year 14, 1991, No. 3, pages 137 to 152, the publication by A. Mann: "Der GSM-Standard—Grundlage für digitale europaische Mobilfunknetze" [The GSM Standard—Basis for digital European mobile radio networks]) and the non-public DECT cordless system with a transmission range of several 100 meters and a frequency range for telecommunications transmission between 1880 and 1900 MHz (Digital European Cordless Telecommunication; cf. the publication entitled Nachrichtentechnik Elektronik [Telecommunications Electronics], Berlin, Year 42, No. 1, 1–2/1992, pages 23 to 29, and the publication by U.Pilger: "Strukur des DECT-Standards" [Structure of the DECT standard]); both use the powerful TDMA transmission method.

The possibility of using RF strip line resonators in mobile radio systems is demonstrated below for the DECT cordless system. In the DECT cordless system which comprises, in the simplest case, a base station with at least one assigned mobile component, high frequency signals are required and processed in radio components with a transmitter/receiver structure.

FIG. 1 shows, for example, the known (publication: the publication entitled ntz, Vol. 46, Issue 10, 1993, pages 754 to 757—"Architekturen für ein DECT-Sende- und Empfangsteil: Ein Vergleich" [Architectures for a DECT transmission and reception component: a comparison]) basic structure of a DECT radio component FKT according to the superheterodyne principle with double frequency conversion. Mixers MIS which mix a traffic signal (such as a transmission or reception signal) up or down (in other words, raise or lower the frequency of the traffic signal) by mixing with an oscillator signal are used for this frequency conversion. In order to generate the oscillator signal, oscillators OSZ1 and OSZ2, which have correspondingly constructed resonators for this, are usually used in the radio component FKT. In this context, the resonators used are preferably RF strip line resonators. A housing H is shown enclosing the component FKT.

FIG. 2 shows the known structure of an RF strip line resonator 1 which is constructed, for example, as a shortened quarter wave resonator. A quarter wave resonator 1 is arranged, for example, on a printed circuit board 2 with a substrate thickness $d_s$ (reference distance). The quarter wave resonator 1 has a strip line 10 which is directly connected at one end—by means of a through-plated hole DK—and is connected via a capacitor 3 at the other end, to a metallic conductor 11—in the present case a metallized conductor surface—which is used here as an earth potential for the strip line 10. The strip line 10 and the metallic conductor 11 are arranged here on opposite faces of the printed circuit board 2. The strip line 10 has a length $l_{ST}$ and a width $b_{ST}$ by which, together with the capacitance of the capacitor 3, the method of forming the through-plated hole DK, the substrate thickness $d_s$ and the dielectric constant $\epsilon_r$ of the printed circuit board 2, the resonant frequency of the quarter wave resonator 1 is determined. By means of the capacitor 3, the strip line resonator 1 is on the one hand adjusted in terms of the resonant frequency and on the other hand shortened in terms of the resonator length $l_{ST}$.

Owing to the dependence of the resonant frequency of the strip line resonator 1 on the parameters given above, the actual resonant frequency of the strip line resonator 1 is also determined by how precisely the strip line resonator 1 can be produced, i.e. how large the manufacturing tolerances are. Tolerances ($\Delta d_s$) in the substrate thickness $d_s$ or quite generally in the distance between the strip line 10 and the metallic conductor 11 (difference between the reference distance $d_s$ and an actual distance $d_s \pm \Delta d_s$) prove particularly problematic.

Moreover, this problem is increased if the strip line resonator 1 described above is surrounded by a metallic housing or housing cover and it is also impossible—for reasons of manufacture—for this metallic conductor to be arranged at a defined distance from the strip line.

SUMMARY OF THE INVENTION

An object on which the invention is based is to provide an RF strip line resonator in which changes in the resonant frequency of the resonator which occur owing to tolerances in the construction of the RF strip line resonator which are due to production and which influence the distance between the strip line and the metallic conductor are compensated.

This and other objects and advantages are achieved on the basis of the RF strip line resonator having a curved strip line which is arranged at a reference distance from a conductor characterized in that the strip line is curved and the curvature is dimensioned such that the displacement in the resonant frequency which is capacitively caused as a result of a deviation in distance between an actual distance and the reference distance is counteracted by an approximately equal inverse inductively caused displacement in the resonant frequency.

By virtue of the fact that a strip line of the RF strip line resonator is no longer of a stretched, as in the prior art, but is rather of a curved construction, eddy currents are induced in a metallic conductor which is located parallel to the strip line and is preferably constructed as a metallic surface. The eddy currents bring about a reduction in the inductance of the RF strip line resonator. The smaller the distance between the strip line and the metallic conductor becomes, the smaller this inductance becomes and similarly the larger the distance between the strip line and the metallic conductor, the larger the inductance. Since the shortening of the distance between the two conductors is however also accompanied by an increase in the capacitance of the RF strip line resonator and an increase of the distance between the two conductors is accompanied by a reduction in the capacitance of the resonator, with appropriate dimensioning of the curved strip line, the two aforesaid effects cancel one another out and the frequency of the RF strip line resonator is approximately stable with respect to the given fluctuations in distance.

Advantageous developments of the invention are provided by the strip line and the conductor being arranged on opposite sides of a printed circuit board. The printed circuit board is surrounded by an electrically conductive housing lid in one embodiment. The conductor is preferably constructed as a metallic surface which is used as ground potential for the strip line. The present RF strip line resonator is preferably used in a wireless telecommunications device. One use of the present RF strip line resonator is in a DECT cordless telephone. Another use is in a GSM mobile radiotelephone.

DETAILED DESCRIPTION OF THE PREFERRED EMBODIMENTS

An exemplary embodiment of the invention is explained with reference to FIG. 3.

Figure 1:
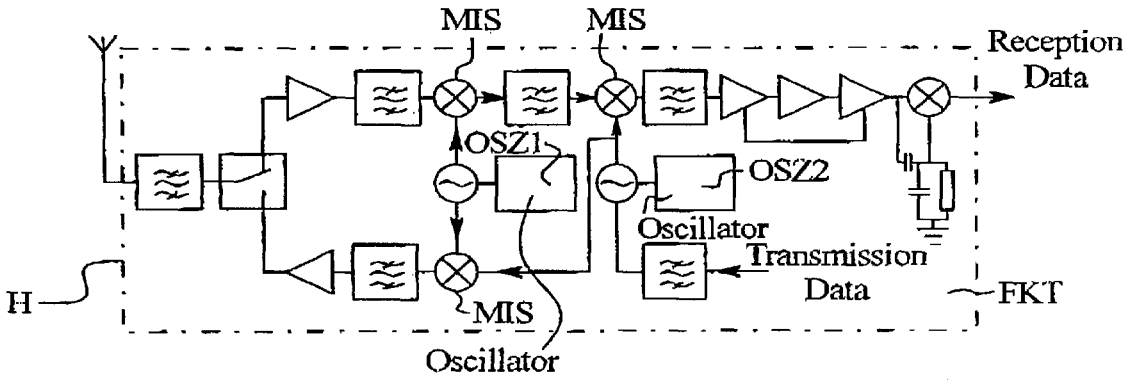
FIG. 1 (PRIOR ART)
FIG. 1 is a schematic block diagram of a known radio transmission and reception circuit.
Figure 2:
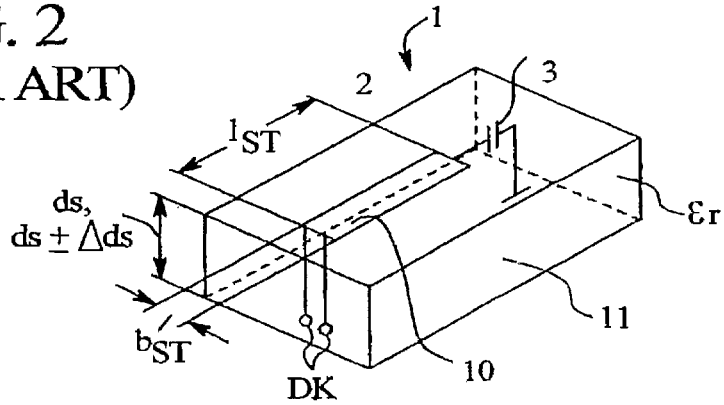
FIG. 2 (PRIOR ART)
FIG. 2 is a perspective view of a known strip line resonator.
Figure 3:
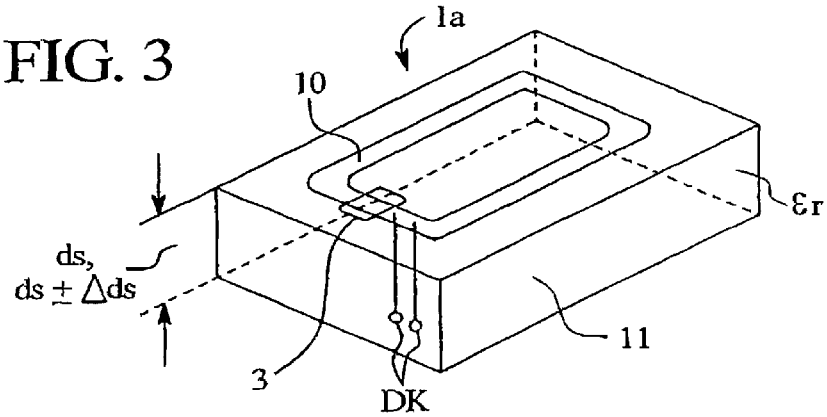
FIG. 3 is a perspective view of a strip line resonator according to the present invention.
Figure 4:
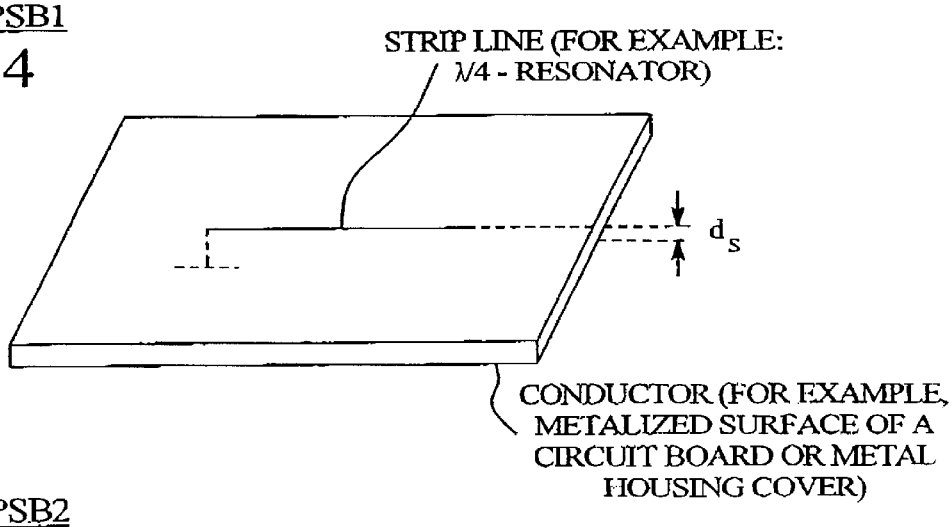
FIGS. 4–13 are schematic perspective view and circuit diagrams showing the determination of the strip dimensions.
Figure 5:
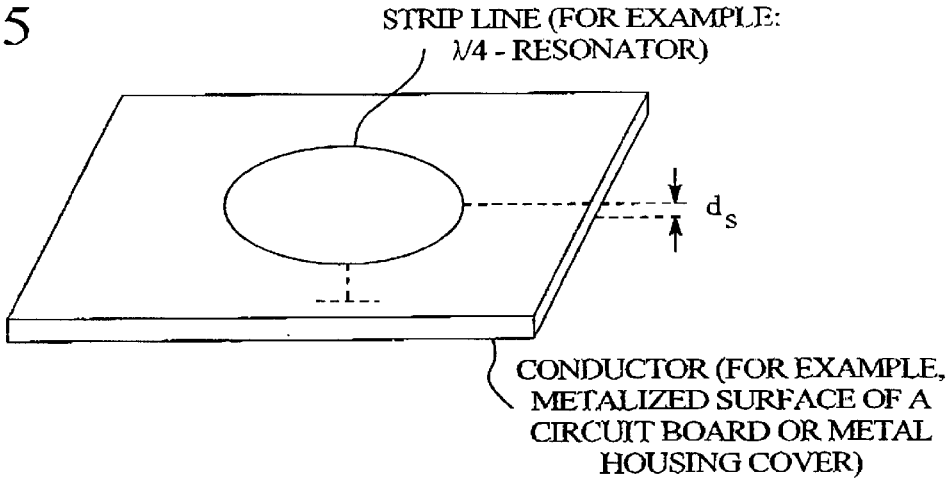
Figure 6:
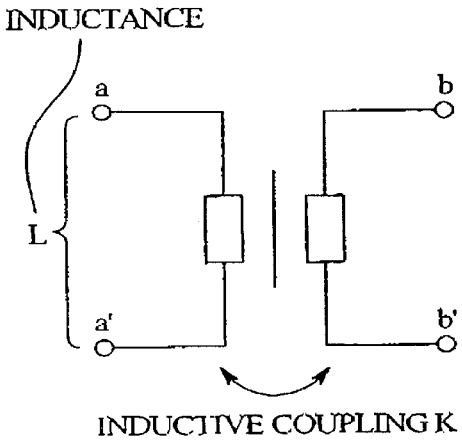
Figure 7:
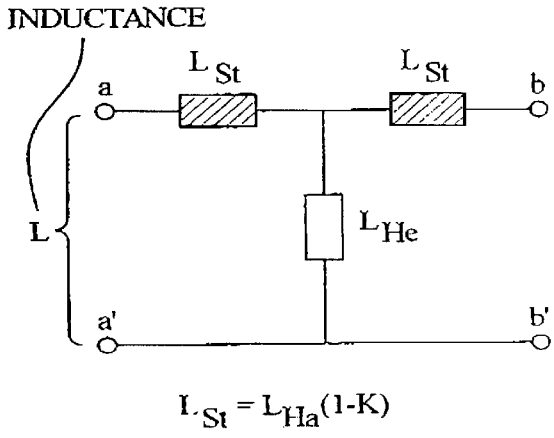
Figure 8:
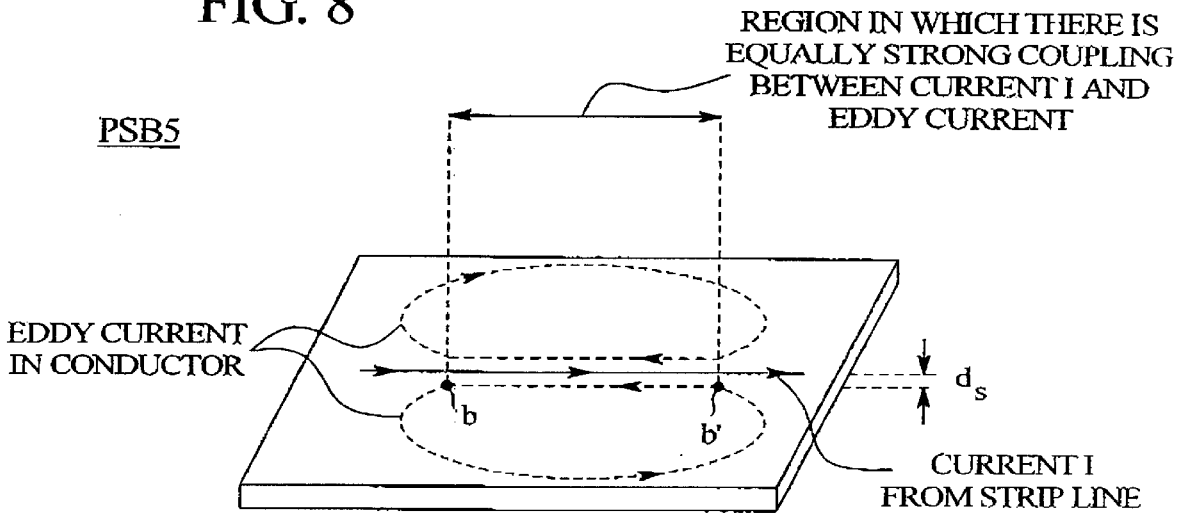
Figure 9:
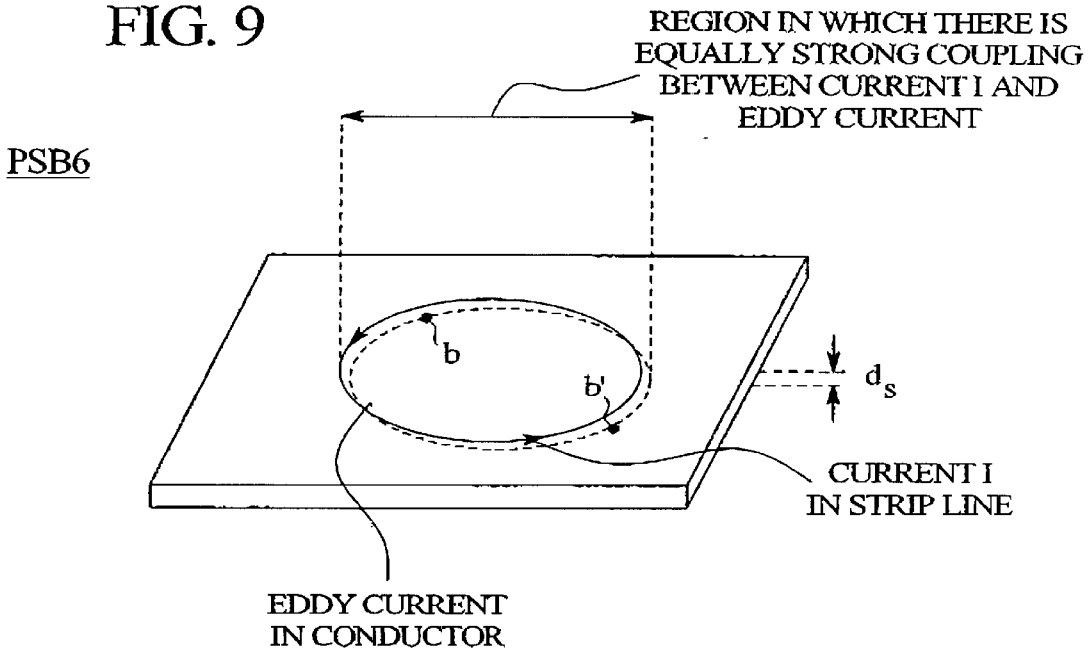
Figure 10:
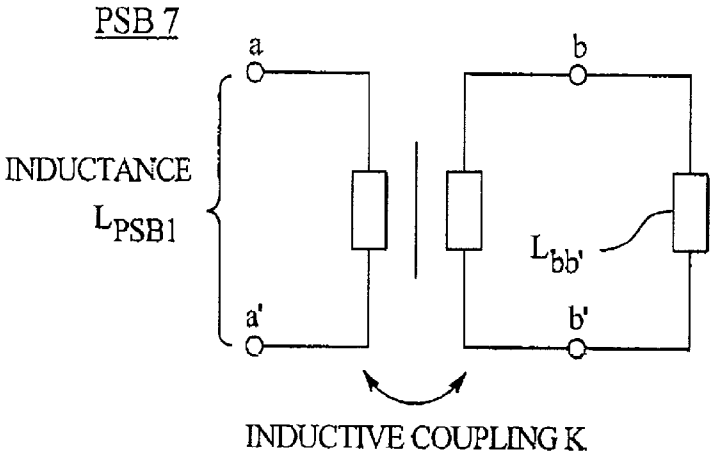
Figure 11:
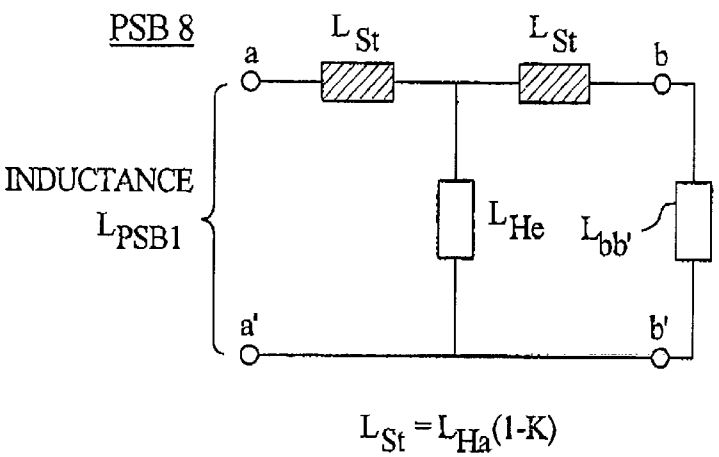
Figure 12:
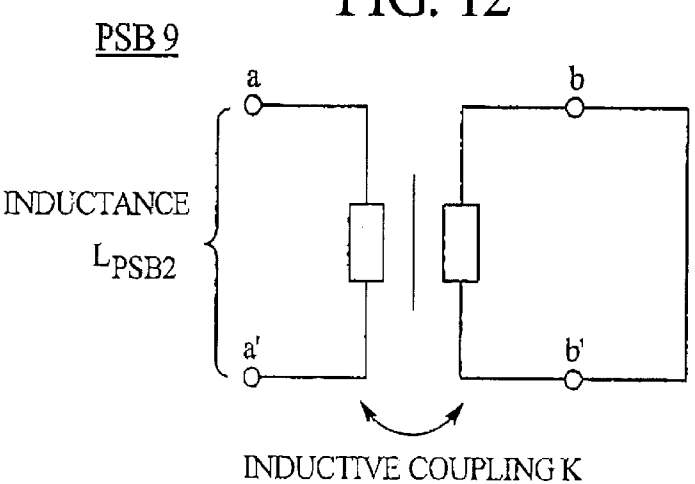
Figure 13:
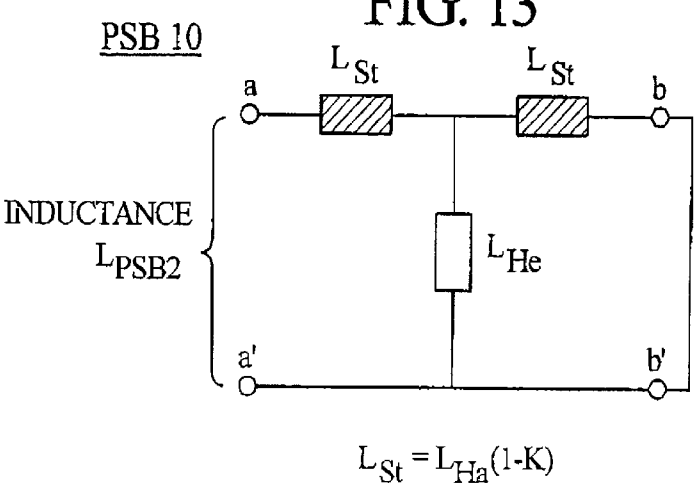

FIG. 3 shows, on the basis of the RF strip line resonator 1 according to FIG. 2, a modified RF strip line resonator la in which the strip line 10 has a curved extent. The curvature is selected here such that when fluctuations in distance occur (reference distance $d_s$ and actual distance $d_s \pm \Delta d_s$) between the strip line 10 and the metallic conductor 11, capacitively caused displacements in the resonant frequency of the RF strip line resonator 1*a* are compensated by approximately equal inverse inductively caused displacements in the resonant frequency.

The present invention makes use of characteristics and relationships of strip lines. An example of how the strip line could be designed is set out below as shown in the drawing FIGS. 4–13, supplementally labeled PSB1–PSB10.

1) The diagrams include:

PSB1 (FIG. 4) shows a straight micro-strip—e.g. constructed as $\lambda/4$-resonator—which is arranged at a distance $d_s$ to a conductor configured as a metallized surface of a circuit board or as a metallized housing cover, for example.

PSB2 (FIG. 5) shows a ring-shaped micro-strip—e.g. designed as a $\lambda/4$-resonator—which again is arranged at a distance $d_s$ to a conductor configured as a metallized surface of a circuit board or as a metallized housing cover, for example.

PSB3 (FIG. 6) shows a transformer diagram.

PSB4 (FIG. 7) shows the equivalent circuit diagram of the transformer according to PSB3.

PSB5 (FIG. 8) shows the distribution of current and eddy current of the micro-strip arrangement according to PSB1 (the straight strip line).

PSB6 (FIG. 9) shows the distribution of current and eddy current of the micro-strip arrangement according to PSB2 (the circular strip line).

PSB7 (FIG. 10) shown the inductive relations of the micro-strip arrangement through which current flows according to PSB1 and PSB5, depicted as transformer diagram according to PSB3.

PSB8 (FIG. 11) shows the equivalent circuit diagram of the transformer diagram according to PSB7.

PSB9 (FIG. 12) shows the inductive relations of the current-passed micro-strip arrangement according to PSB2 and PSB6 depicted as transformer diagram according to PSB3.

PSB10 (FIG. 13) shows the equivalent circuit diagram of the transformer diagram according to PSB9.

2) The idea on which the present invention is based is to form the curvature of the HF (high frequency) micro-strip of a micro-strip arrangement which has a curved HF-micro-strip. In the arrangement disclosed in the present application, for the micro-strip arrangement—as in known micro-strip arrangements—there does not arise a shift of the resonant frequency of the micro-strip. It is a matter of an optimization process which is difficult to indicate with mathematical formulas. The following considers dimensioning limits of the optimization process proceeding from the diagrams PSB1 and PSB2, using the diagrams PSB3–PSB10. Based on the insights shown herein, the technical teachings can be applied for different micro-strip arrangements.

3) The resonant frequency of a micro-strip—e.g. the micro-strip according to the diagrams PSB1 and PSB2—is determined by the following proportionality relation: Generally: $f_{res} \approx 1/(LC)^{1/2}$, wherein L represents the inductance and C, the capacitance. Diagrams PSB1 and PSB2: $f_{res} \approx 1/(L_{PSB1,2} C_{PSB1,2})^{1/2}$, wherein $L_{PSB1,2}$ represents the inductance of the diagrams PSB1 and PSB2 and $C_{PSB1,2}$ represents the capacitance of the principle diagrams PSB1 and PSB2.

4) Consideration of Capacitance

Proceeding from the general formula $C=\epsilon_o\ \epsilon_r\ A/d$ for a plate capacitor, wherein $\epsilon_o$ represents the permittivity of free space, $\epsilon_r$ represents the relative permittivity, A represents the area of one capacitor plate and d represents the distance between the capacitor plates, the capacitance $C_{PSB1}$ of the micro-strip arrangement according to PSB1 can be calculated using the formula $$C_{PSB1}=\epsilon_o\ \epsilon_r\ A/d_s.$$

In accordance therewith, the formula for calculating the capacity $C_{PSB2}$ of the micro-strip arrangement according to PSB2 is:

$$C_{PSB2}=\epsilon_o\ \epsilon_r\ A/d_s.$$

From the calculation for the capacitances $C_{PSB1}$ and $C_{PSB2}$ the relation can be derived, whereby the capacitance $C_{PSB1}$ and $C_{PSB2}$ is inversely proportional to the distance $d_s$. This means that when the distance $d_s$ decreases, the capacitance $C_{PSB1}$ and $C_{PSB2}$ increases.

5) Consideration of Inductance 5.1). For the consideration of the inductive relations in the micro-strip resonators according to diagrams PSB1 and PSB2, a simplified transformer diagram is used with two transformer coils coupled inductively with a coupling factor K according to PSB3, along with its equivalent circuit diagram according to PSB4. The equivalent circuit diagram of the transformer is essentially an inductive T-network with a main inductance $L_{Ha}$ and two leakage inductances $L_{st}$, wherein the relation between leakage inductance and main inductance is given by the formula $$L_{St}=L_{Ha}(1-K).$$

The inductance L of the transformer is consequently a function of Lst and Lha, or respectively, mathematically expressed $L=f(L_{St},L_{Ha})$. The formula $L_{St}=L_{Ha}(1-K)$ also results in functional dependence on the coupling K for the inductance L. Thus, L=f(K) also applies. The inductive coupling K can assume values only in the area $0<K<1$, given values for the main inductance and leakage inductance which are exclusively positive for physical reasons. When the transformer coils are arranged at a distance $d_{min}(d<<1)$, then for the value K=1, the coupling K is maximally ($K_{max}$), and thus the leakage inductance $L_{St}=0$. On the other hand, when the transformer coils are arranged at a distance $d_{max}$ ($d>>1$), then the coupling K for values $K<<1$ is minimally ($K_{min}$), and thus the leakage inductance $L_{St}=L_{Ha}$.

5.2). In order to transfer these ideas onto the diagrams PSB1 and PSB2, diagram PSB5 depicts the current distribution and eddy current distribution of the micro-strip arrangement according to PSB1, and PSB6 depicts the current distribution and eddy current distribution of the micro-strip arrangement according to PSB2. The principle diagrams PSB5 and PSB6 contain areas drawn in bold with an equally strong coupling K between the current of the micro-strip and the eddy current of the conductor. While in diagram PSB5 this area extends only over a part of the eddy current, this region extends over the entire eddy current distribution in PSB6.

For a conceptual experiment based on the idea of moving from a point b to a point b' in the direction of the eddy current in the principle wiring diagrams PSB5 and PSB6, this means that in PSB5 an area with a different coupling has to be "traversed" and therefore an additional inductance $L_{bb'}$, which is much larger in comparison to the eddy inductance, has to be overcome, and that in PSB6 the area with the same coupling can be "traversed," and therefore no additional inductance $L_{bb'}$ has to be overcome whatsoever.

If these insights are transferred onto the transformer diagram PSB3 and the transformer replacement wiring diagram PSB4, there result on the one hand, the principle wiring diagrams PSB7 and PSB8 for the principle wiring diagram PSB5, and on the other hand, the principle wiring diagrams PSB9 and PSB10 for the principle wiring diagram PSB6.

In the principle wiring diagram PSB7 the additional inductance $L_{bb'}$ occurs at the secondary side between the terminals (b-b'), while in the principle wiring diagram PSB9 the terminals (b-b') are shorted at the secondary side.

According to PSB8 and PSB10, it results that the change of the distance $d_s$, or respectively, of the coupling K in PSB10 has a stronger influence on the inductance $L_{PSB2}$ than on the inductance $L_{PSB1}$ in PSB8, because, due to the relation $L_{Ha}>>L_{bb'}$, the inductance $L_{PSB1}$ cannot be less than the additional inductance $L_{bb'}$.

Thus, the optimal curvature lies between the two dimensioning limits (PSB1 and PSB2), depending on the micro-strip arrangement.

Figure 14:
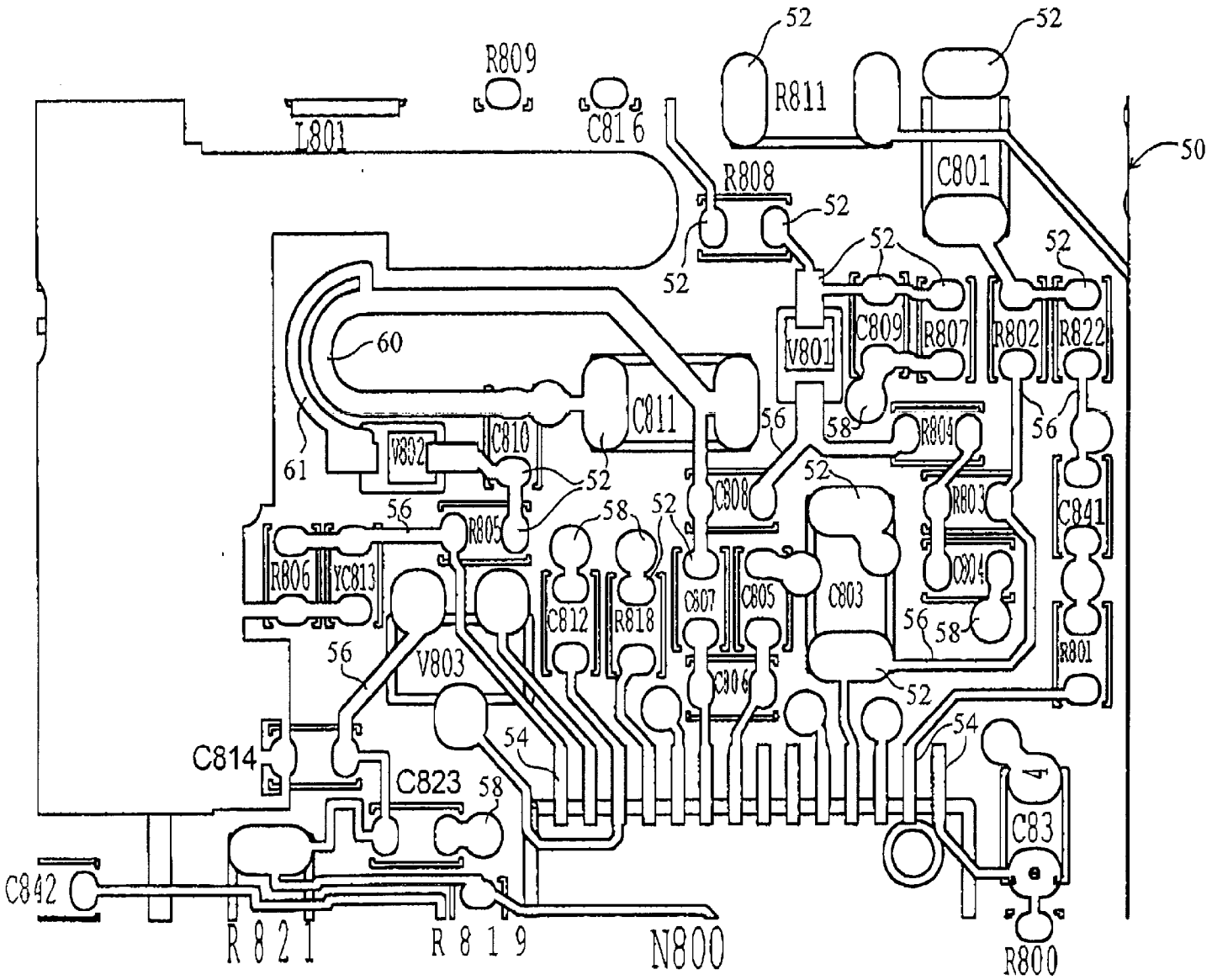
FIG. 14 is a detailed plan view of the physical circuit board including the strip line resonator according to the present invention.

Referring to FIG. 14, a printed circuit board 50 having mounting locations 52 for surface mounted components in a mobile telephone circuit is shown. The mounting locations 52 are marked with indicia to indicate the component type and number to be mounted at each location. For instance, the locations marked with indicia beginning with a C are provided for mounting a capacitor and the locations marked with indicia beginning with an R are provided for mounting a resistor. Locations for mounting an inductor L and a diode V are also shown. The circuit board layout also has locations 54 for connection of an integrated circuit, at a location indicated by an N800. The mounting locations 52 and 54 are connected to one another by conductor runs 56. The illustrated circuit includes both radio frequency circuit portions and low frequency circuit portions.

The mounting locations 52 and 54 and conductor runs 56 are formed by etching a pattern into a layer of conductive material, such as FR4, on the top surface of a blank circuit board, leaving behind the shapes as shown. Some of the conductor runs 56 connect to vias, or conductive connections, 58 that pass partly or completely through the circuit board 50. The circuit board may be a single layer or a multi layer circuit board as is well known. In one example, the circuit board is a four layer circuit board.

The present invention provides that at least one of the conductor runs on the circuit board surface is shaped to function as a waveguide in a resonator for the radio frequency signal. The waveguide 60 is shaped in a curve that has a stabilizing effect on the circuit and overcomes capacitance effects caused by tolerance variations of the mobile telephone housing. In particular, the circuit board, in use, is mounted within a mobile telephone housing. The housing includes conductive elements, such as metallic plates, and these conductive housing elements interact with the circuit elements and conductors on the circuit board 50 to effect the electrical characteristics of the circuit elements. The tolerance variations in assembly of the telephones result in the housing elements being spaced at different distances from the circuit board 50 from one phone to the next, so that differences in the electrical circuit performance arise from this unexpected source. In particular, the relationship between the capacitance and the inductance in the circuit is changed. These differences in electrical characteristics have a detrimental effect on the operation of the mobile telephone, such as by changing the resonant frequency of the resonator. By curving the waveguide 60 lead as shown, the effects from tolerance variations in the structure of the mobile telephone are reduced or eliminated so that circuit characteristics are stabilized and circuit operation is predictable.

In one example, the casing of the mobile telephone is spaced 2.5 mm from the circuit board and tolerance variations provide for a 10% variation in the distance therebetween.

Another factor effecting the circuit operation is pressure on the housing of the mobile phone, which moves the metallic housing components relative to the circuit board 50. These changes in distance translate as changes in capacitance, which change the resonant frequency. The curved strip line of the present invention causes the inductance of the strip line to change as well for different distances between the housing and the circuit board. The change in capacitance from the different distances is compensated by the changes in inductance. The relationship between the capacitance and the inductance of the curved waveguide in the resonator is seen as significant.

In the example shown, the waveguide 60 has a capacitor C811 connected across the ends thereof and a diode V802 connected to an intermediate location by a curved conductor run 61. Neither the capacitor C811 nor the diode V802 and the curved conductor run 61 are necessary to achieve the advantages of the present invention.

Figure 15:
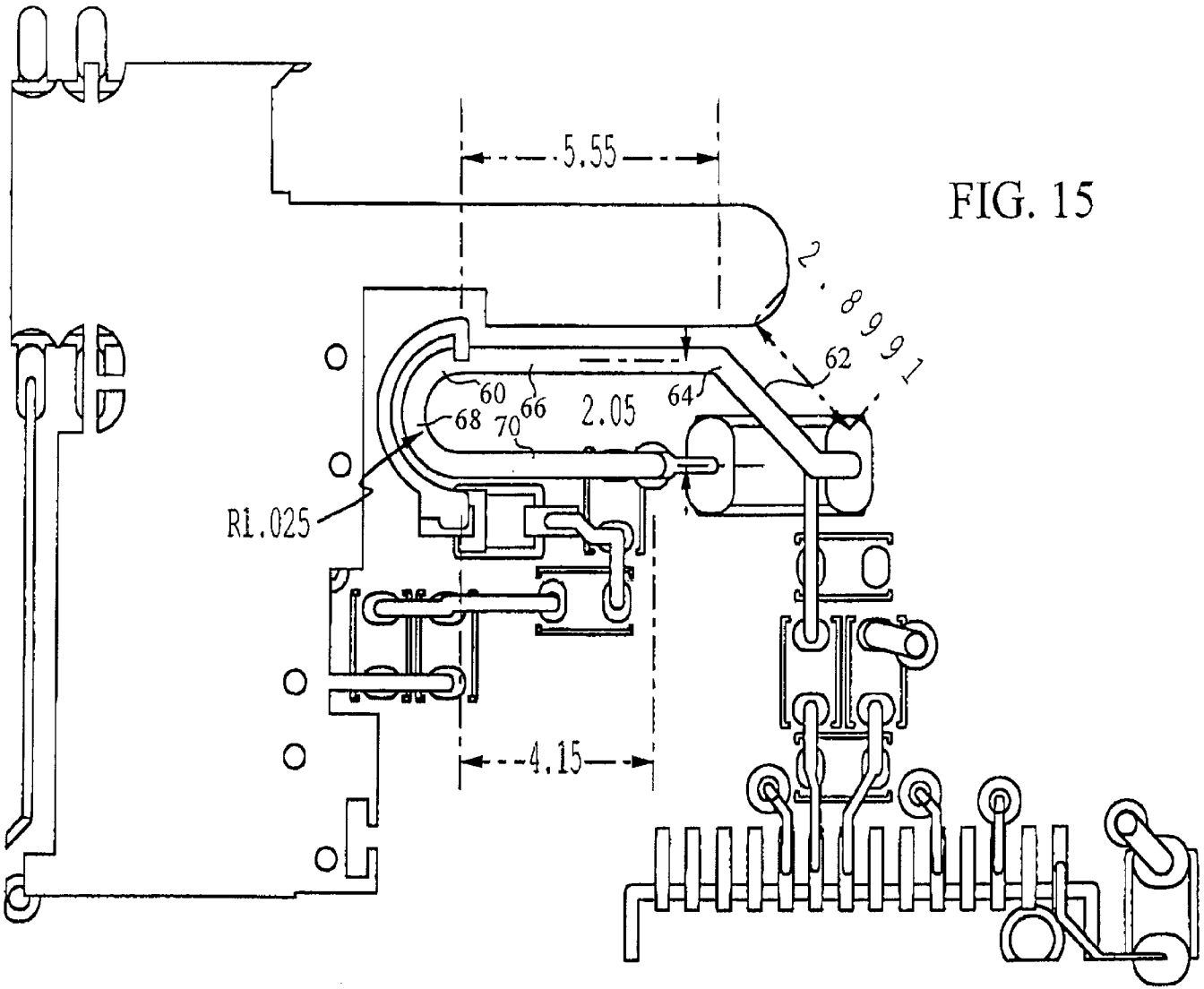
FIG. 15 is a detailed view of the strip line resonator of FIG. 14.

In FIG. 15, the curved waveguide 60 is shown in greater detail including the dimensions of the illustrated embodiment. In particular, the waveguide 60 has a first straight portion 62 of length 2.8991 mm to an angle 64, a second straight portion 66 of length 5.55 mm from the angle 64 to the curve 68. The curve 68 according to the illustrated embodiment is along a center radius of 1.025 mm and extends 180 degrees so that the return 70 is parallel to the entry 66. It is contemplated that other curvatures of the waveguide may also be provided, for example, a 135 degree curvature may be used in one embodiment. The return 70 of the waveguide is a straight section of length 4.15 mm that is spaced 2.05 mm from the straight portion 66. The waveguide 60 has a thickness from the circuit board surface of approximately 0.36±10% and is of a width of 0.5 mm. The thickness of the conductor run is believed to have no effect on the performance of the present device, whereas the curvature is considered the important aspect of the invention, and specifically the inner part of the curvature.

Figure 16:
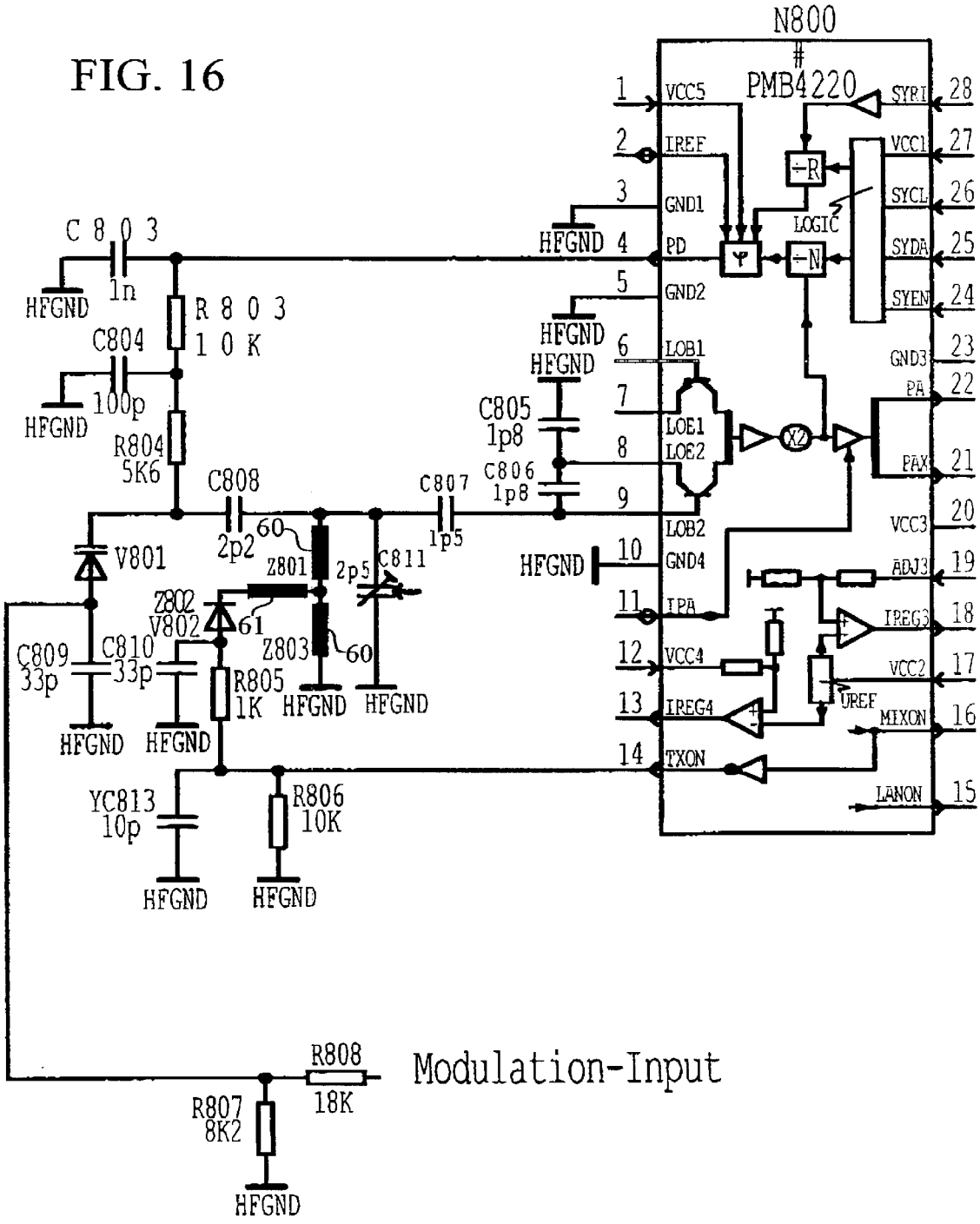
FIG. 16 is a circuit diagram of a portion of the circuit having the strip line resonator.

FIG. 16 is the circuit diagram for the circuit shown in FIGS. 14 and 15. The waveguide 60 corresponds to the elements Z801 and Z803 in the circuit diagram while the curved run 61 is shown as Z802 leading to the diode V802. The capacitor C811 can be seen connected across the waveguide 60. The remaining elements shown in the drawing relate to the particular functions of the mobile telephone circuit but are not relevant to the present invention and so are not discussed in detail herein.

Thus, there is shown and described a strip line resonator which provides a capacitively induced shifting of the resonant frequency of the strip line that is compensated by a specific curvature of the strip line such that the resonant frequency shift is inductively induced by the curvature and is inverse to and approximately equal to the capacitively induced resonant frequency shift so that the shifts counteract each other. The curvature of the strip line is dimensioned such that the resonant frequency shift is capacitively induced by a distance deviation between the actual distance of the strip line relative to the metallic conductor and a target distance of the strip line to the metallic conductor. The capacitively induced shift is counteracted by the generally equal and inverse inductively induced shift.

Although other modifications and changes may be suggested by those skilled in the art, it is the intention of the inventors to embody within the patent warranted hereon all changes and modifications as reasonably and properly come within the scope of their contribution to the art.

We claim:

1. An RF strip line resonator, comprising:

a conductor;

a curved strip line at a reference distance from said conductor, said strip line being curved and being of a curvature that is dimensioned such that a displacement in a resonant frequency which is capacitively caused as a result of a deviation in distance between an actual distance and the reference distance, is counteracted by a substantially equal inverse inductively caused displacement in the resonant frequency.

2. A RF strip line resonator as claimed in claim 1, further comprising:

a circuit board on opposite sides of which are disposed said strip line and said conductor.

3. A RF strip line resonator as claimed in claim 2, further comprising:

an electrically conductive housing surrounding said circuit board with said strip line and said conductor.

4. A RF strip line resonator as claimed in claim 2, wherein said conductor is a metallic surface which is used as ground potential for the strip line.

5. An RF strip line resonator as claimed in claim 1, wherein said strip line follows a path in a shape of a rectangle having rounded corners.

6. A DECT cordless telephone having an improved RF strip line resonator, comprising:

a conductor;

a curved strip line at a reference distance from said conductor, said strip line being curved and and being of a curvature that is dimensioned such that a displacement in a resonant frequency which is capacitively caused as a result of a deviation in distance between an actual distance and the reference distance, is counteracted by an approximately equal inverse inductively caused displacement in the resonant frequency.

7. A GSM mobile radiotelephone having an improved RF strip line resonator, comprising:

a conductor;

a curved strip line at a reference distance from said conductor, said strip line being curved and being of a curvature that is dimensioned such that a displacement in a resonant frequency which is capacitively caused as a result of a deviation in distance between an actual distance and the reference distance, is counteracted by an approximately equal inverse inductively caused displacement in the resonant frequency.

8. A wireless telecommunications device having an improved RF strip line resonator, comprising:

a conductor;

a curved strip line at a reference distance from said conductor, said strip line being curved and and being of a curvature that is dimensioned such that a displacement in a resonant frequency which is capacitively caused as a result of a deviation in distance between an actual distance and the reference distance, is counteracted by an approximately equal inverse inductively caused displacement in the resonant frequency.

* * * * *